US006311160B1

(12) United States Patent
Imade

(10) Patent No.: US 6,311,160 B1
(45) **Date of Patent: *Oct. 30, 2001**

(54) CODE IMAGE RECORDING APPARATUS HAVING A MICROPHONE, A LOUDSPEAKER AND A PRINTER

(75) Inventor: Shinichi Imade, Iruma (JP)

(73) Assignee: Olympus Optical Co., Ltd., Tokyo (JP)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 12 days.

This patent is subject to a terminal disclaimer.

(21) Appl. No.: 09/164,723

(22) Filed: Oct. 1, 1998

(30) Foreign Application Priority Data

Oct. 9, 1997 (JP) ..... 9-277422

(51) Int. Cl.[7] ..... G10L 21/06
(52) U.S. Cl. ..... 704/276; 704/270
(58) Field of Search ..... 704/235, 276, 704/260, 270

(56) References Cited

U.S. PATENT DOCUMENTS 5,923,624 * 7/1999 Groeger et al. ..... 369/7
6,009,393 * 12/1999 Sasaki ..... 704/258
6,043,899 * 3/2000 Morohashi et al. ..... 358/1.18

FOREIGN PATENT DOCUMENTS 0 670 555 A1 9/1995 (EP) .

* cited by examiner

*Primary Examiner*—Richemond Dorvil
*Assistant Examiner*—Angela A. Armstrong
(74) *Attorney, Agent, or Firm*—Frishauf, Holtz, Goodman, Langer & Chick, P.C.

(57) ABSTRACT

The operation mode control section sets an operation mode flag that authorizes the loudspeaker to replay the speech input through the microphone while the speech is being compressed and encoded into speech data by the compression/encoding section and then further processed by the encoding processing section. When an order is issued by the user to confirm the input speech by means of the replay operation section during the encoding operation, the speech output control section receives a permit signal for reproducing the speech through the loudspeaker after expanding the speech data by means of the speech data expansion processing section. The encoding operation proceeds concurrently during the speech reproducing operation.

4 Claims, 9 Drawing Sheets

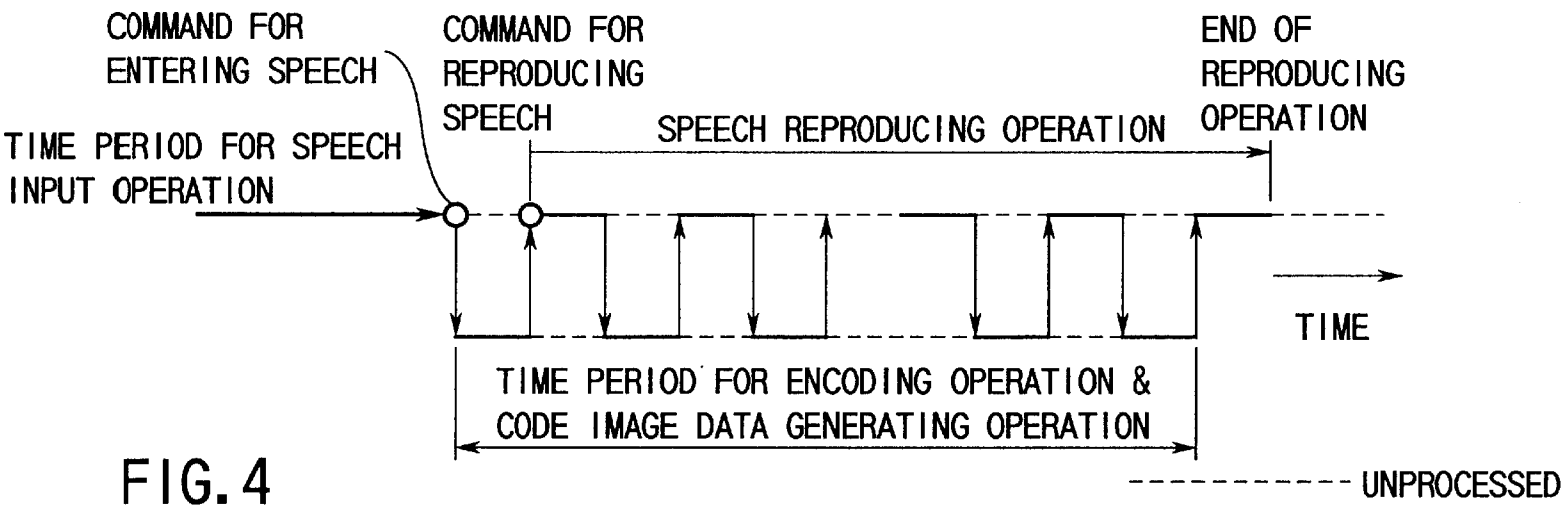

FIG. 4

FIG. 7

| OPERATION MODE FLAG | SPEECH INPUT OPERATION USING MICROPHONE | REPLAY OPERATING USING LOUDSPEAKER | PRINTER OUTPUT OPERATION | SPEECH/CODE IMAGE CONVERTING OPERATION |
|---|---|---|---|---|
| 00000001 | AUTHORIZED | UNAUTHORIZED | UNAUTHORIZED | UNAUTHORIZED |
| 00000010 | UNAUTHORIZED | AUTHORIZED | UNAUTHORIZED | UNAUTHORIZED |
| 00000100 | UNAUTHORIZED | UNAUTHORIZED | AUTHORIZED | UNAUTHORIZED |
| 00001000 | UNAUTHORIZED | UNAUTHORIZED | UNAUTHORIZED | AUTHORIZED |

CODE IMAGE RECORDING APPARATUS HAVING A MICROPHONE, A LOUDSPEAKER AND A PRINTER

BACKGROUND OF THE INVENTION

This invention relates to a code image recording apparatus adapted to record speech entered through a microphone by printing it on a predetermined printing medium in the form of an optically readable code image and reproducing the entered speech by means of a loudspeaker.

The assignee of the present patent application has proposed a recording apparatus for recording speech by printing it on a predetermined printing medium in the form of an optically readable code image of dot codes in EP 0,670,555 A1 (U.S. Ser. No. 08/407,018).

FIGS. 1A and 1B of the accompanying drawings schematically illustrate the configuration of the physical format of dot codes to be used for the proposed recording apparatus. The code pattern 1 comprises a plurality of blocks 2 arranged two-dimensionally on a side by side basis. Each block 2 in turn comprises a data area 3, markers 4 and a block address pattern 5.

The data area 3 contains white dots and black dots representing respective data values of "0s" and "1s" that are assigned to each block as speech data and arranged according to a predetermined format of arrangement to produce a white dot image or a black dot image. The markers 4 are black markers arranged at the four corners of the block 12 to provide a reference point for detecting each dot in the data area 3, each of the markers 4 being formed by a certain number of consecutively arranged black dots. The block address pattern 5 is arranged between adjacently located markers 4 to make the block 2 discriminable from other blocks 2 and contains white dots and black dots representing respective data values of "0s" and "1s" that are assigned to each block as address data including an error detecting or error correcting code. The vertical and horizontal lines connecting the dots in the drawing are used for the ease of understanding and they do not exist in real code images.

A system using dot codes arranged with the above described physical format provides an advantage that the original data can be restored by rearranging the data of the blocks according to their respective addresses if all the dot codes of the data covers an area greater than the area that can be taken by the solid state image sensing device of the image reader or, differently stated, if the entire dot codes of the data cannot be picked up by a single shot, provided that the address of each of the blocks is contained in any of the images taken by the image reader. Therefore, such a dot code system can store a huge volume of data on a single sheet of paper in a manner that can be achieved by no other known one-dimensional or two-dimensional bar code system so that speech data can be transmitted or transported in a simple manner by means of a recording medium such as paper. Thus, the dot code system may have a wide variety of applications that are not conceivable with known code systems.

The code image recording apparatus may be an ordinary printer or a label printer adapted to print and record optically readable dot codes continuously on label-like sheets of paper being fed also continuously along a given direction.

The use of a label printer for a code image recording apparatus is very promising because it is portable and easy to use and hence provides a broad opportunity of utilization.

However, label printers or not, known code image recording apparatuses have problems to be overcome before they get a high market value.

More specifically, a code image recording apparatus of the type under consideration takes a relatively long time for it to transform a speech input through a speech input means such as microphone into a code image of encoded data in the form of dot codes arranged according to a predetermined format and therefore the user can often be held in a stand-by state where he or she will have to wait for the completion of the current process of transforming the speech into a code image. Thus, the user can have the apparatus print the code image only after the completion of the process, and this creates a considerable inconvenience.

On the other hand, the user of a code image recording apparatus of the type under consideration may more often than not want to reproduce the speech he or she has input through the microphone by way of the loudspeaker in order to quickly and audibly ensure the input. Thus, how to meet the requirement of audibly ensuring the speech input is a problem to be solved along with the above identified problem of a long stand-by time.

BRIEF SUMMARY OF THE INVENTION

In view of these and other problems, it is therefore the object of the present invention to provide a code image recording apparatus adapted for the user to ensure the speech input by him or her by reproducing it through a speech output means, utilizing the stand-by time necessary for the apparatus to complete the process of transforming the input speech into a code image.

According to a first aspect of the present invention, there is provided a code image recording apparatus comprising:

speech input means for inputting speech;

code image converting means for converting the speech input by the speech input means into a code image of encoded data arranged according to a predetermined format;

a printer for printing the code image converted by the code image converting means on a predetermined printing medium as an optically readable image;

speech output means for outputting the speech input by the speech input means;

operation mode setting means for setting a speech output mode adapted to cause the speech output means to output the speech input by the speech input means and a code image conversion mode adapted to cause the code image converting means to convert the speech input by the speech input means; and mode selection control means for allowing, when one of the above operation modes is set by the mode setting means, the operation mode setting means to further set another operation mode.

According to a second aspect of the present invention, there is provided a code image recording apparatus comprising:

speech input means for inputting speech;

code image converting means for converting the speech input by the speech input means into a code image of encoded data arranged according to a predetermined format;

a printer for printing the code image converted by the code image converting means on a predetermined printing medium as an optically readable image;

speech output means for outputting the speech input by the speech input means;

operation mode setting means for setting a speech output mode adapted to cause the speech output means to output the speech input by the speech input means and a code image conversion mode adapted to cause the code image converting means to convert the speech input by the speech input means; and mode selection control means for enabling the operation mode setting means to set the code image conversion mode after the speech output mode has been set.

According to a third aspect of the present invention, there is provided a code image recording apparatus comprising:

speech input means for inputting speech;

code image converting means for converting the speech input by the speech input means into a code image of encoded data arranged according to a predetermined format;

a printer for printing the code image converted by the code image converting means on a predetermined printing medium as an optically readable image;

speech output means for outputting the speech input by the speech input means;

operation mode setting means for setting a speech output mode adapted to cause the speech output means to output the speech input by the speech input means and a code image conversion mode adapted to cause the code image converting means to convert the speech input by the speech input means; and mode selection control means for enabling the operation mode setting means to set the speech output mode after the code image conversion mode has been set.

According to a fourth aspect of the present invention, there is provided a code image recording. apparatus comprising:

speech input means for inputting speech;

code image converting means for converting the speech input by the speech input means into a code image of encoded data arranged according to a predetermined format;

a printer for printing the code image converted by the code image converting means on a predetermined printing medium as an optically readable image;

speech output means for outputting the speech input by the speech input means;

operation mode setting means for setting a speech output mode adapted to cause the speech output means to output the speech input by the speech input means and a code image conversion mode adapted to cause the code image converting means to convert the speech input by the speech input means; and mode selection control means for controlling the operation mode setting means to compulsorily set the speech output mode after the code image conversion mode has been set.

Additional objects and advantages of the invention will be set forth in the description which follows, and in part will be obvious from the description, or may be learned by practice of the invention. The objects and advantages of the invention may be realized and obtained by means of the instrumentalities and combinations particularly pointed out hereinafter.

BRIEF DESCRIPTION OF THE SEVERAL VIEWS OF THE DRAWING

The accompanying drawings, which are incorporated in and constitute a part of the specification, illustrate presently preferred embodiments of the invention and, together with the general description given above and the detailed description of the preferred embodiments given below, serve to explain the principles of the invention.

FIG. 4 is an illustration showing the temporal relationship between the processing operation of reproducing an input speech and those of encoding the input speech and generating code image data for the input speech;

FIG. 7 is a chart illustrating operation mode flags to be used for the embodiment of FIG. 2.

DETAILED DESCRIPTION OF THE INVENTION

Now, the present invention will be described by referring to the accompanying drawings that illustrate a preferred embodiment of the invention.

Figure 1A:
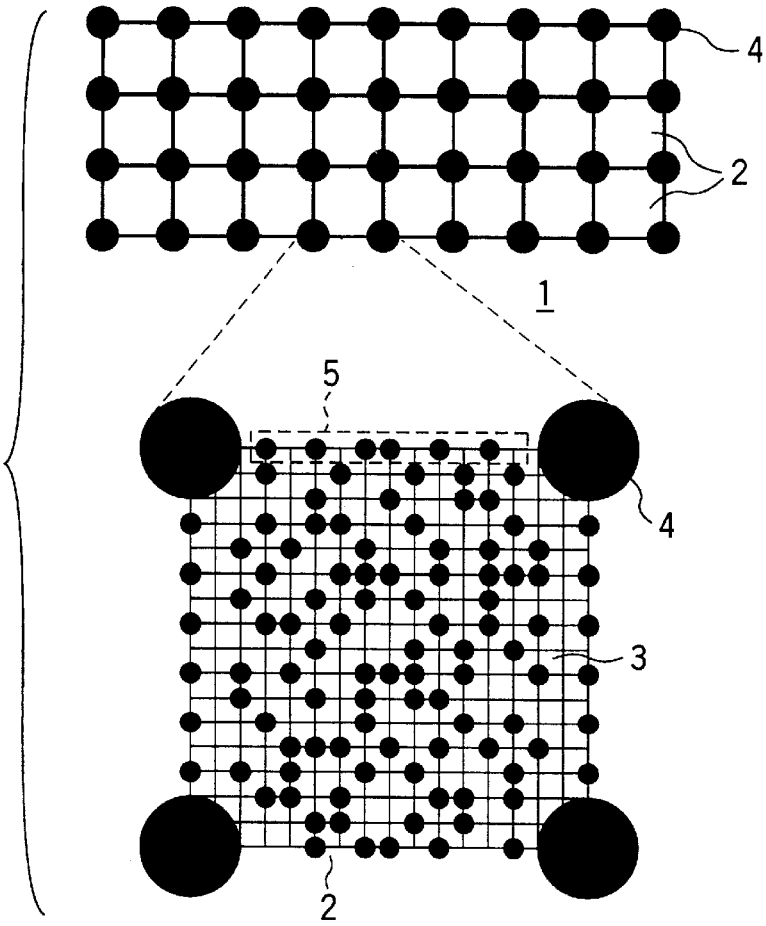
FIG. 1A PRIOR ART
FIG. 1A is a schematic illustration of a physical format of dot codes to be printed on a printing medium for the purpose of the invention.
Figure 1B:
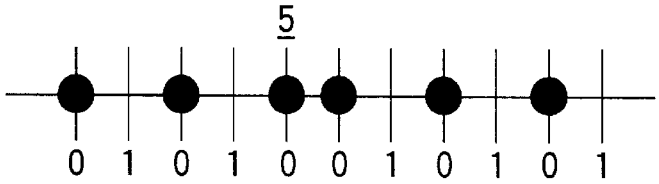
FIG. 1B PRIOR ART
FIG. 1B is a schematic illustration of the block address of the dot code of FIG. 1A.
Figure 2:
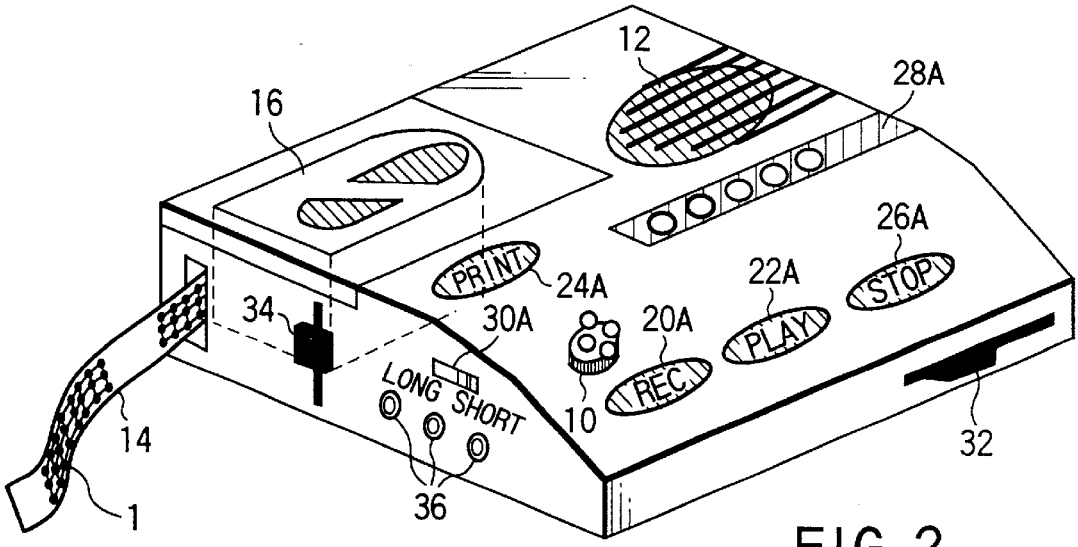
FIG. 2 is a schematic perspective view of a first embodiment of code image recording apparatus according to the invention.
Figure 3:
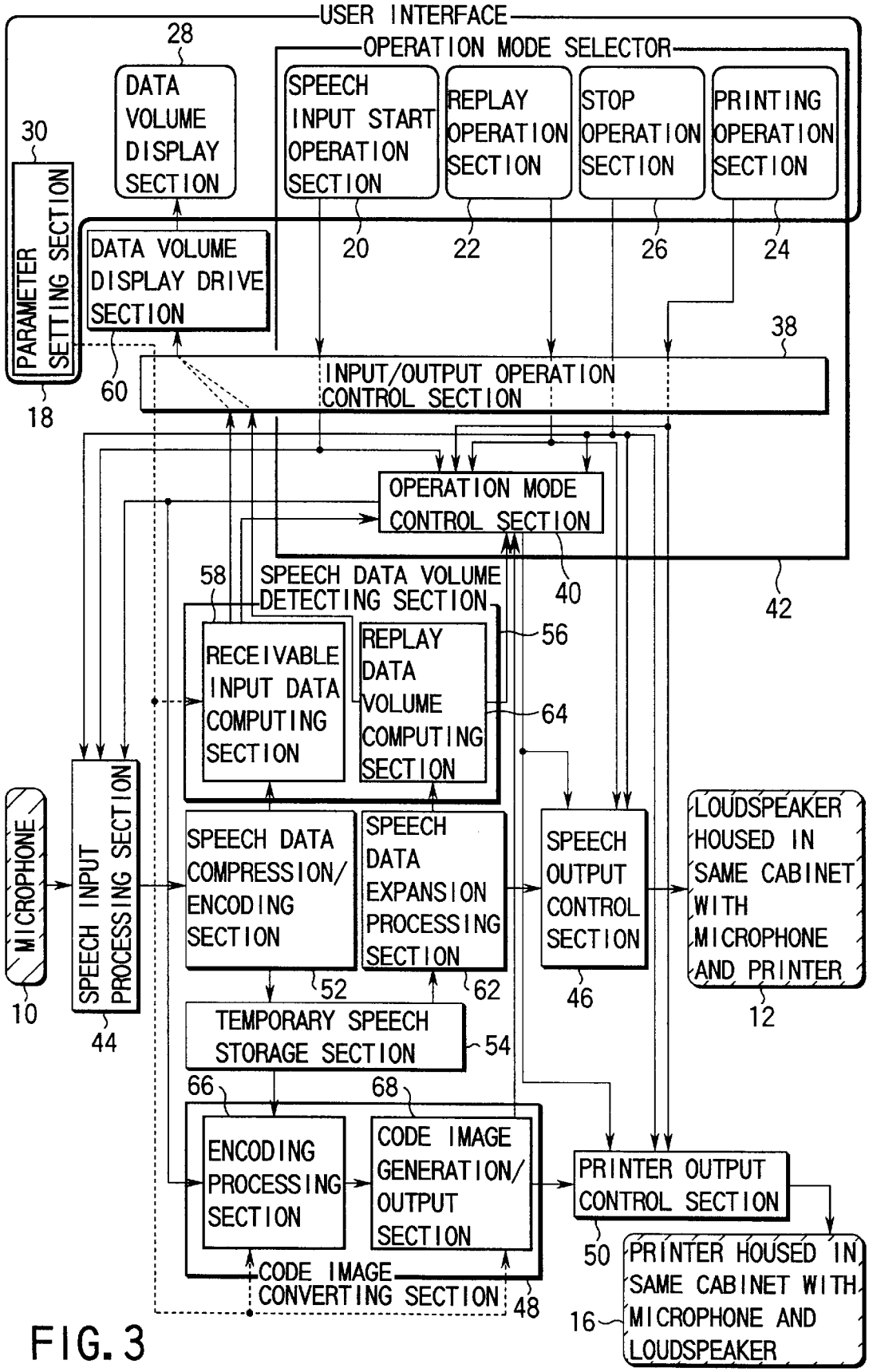
FIG. 3 is a schematic block diagram of the embodiment of code image recording apparatus of FIG. 2.

FIG. 2 is a schematic perspective view of a first embodiment of code image recording apparatus according to the invention and FIG. 3 is a schematic block diagram of the embodiment of code image recording apparatus of FIG. 2. The code image recording apparatus comprises a microphone 10 for speech input, a loudspeaker 12 for reproducing the input speech for the purpose of confirmation and a printer 16 for printing a dot code pattern 1 on a label-like printing medium 14, the microphone 10, the loudspeaker 12 and the printer 16 being contained in a single cabinet.

The code image recording apparatus is provided with a speech input start operation section 20, a replay operation section 22, a printing operation section 24, a stop operation section 26, a data volume display section 28 and a parameter setting section 30 arranged on the top and lateral sides of the cabinet.

The speech input start operation section 20 is in fact a "REC" button 20A for starting a speech input operation through the microphone 10 whereas the replay operation section 22 is in fact a "PLAY" button 22A for starting a speech reproducing operation through the loudspeaker 12. The printing operation section 24 and the stop operation section refer respectively to a "PRINT" button 24A for starting an operation of printing a dot code pattern 1 by means of the printer 16 and a "STOP" button 26A for terminating the current operation. The data volume display section 28 is in fact a volume of receivable input/progress of speech reproduction indicator 28A typically comprising five LEDs for indicating the volume of receivable input determined by the preselected total volume of speech input and the volume of input received by microphone 10 and the progress of speech reproduction through the loudspeaker 12.

The parameter setting section 30 includes a long/short mode selector switch 30A for specifying the mode of recording a dot code pattern 1 on a label-like printing medium 14, a total volume of speech input preselecting section and a parameter input section for entering parameters necessary for preparing a dot code pattern 1, although the parameter setting section 30 may alternatively comprise a ROM for storing parameters so that the user may not be required to enter parameters. The long mode and the short mode described above as mode of recording the dot code pattern 1 refer to the respective lengths of the parts to be used when a dot code pattern is divided into a plurality of parts with an interval arranged between any two successive parts so that the dot code pattern may be printed on so many label-like pieces of printing medium 14. For example, the long mode may refer to the use of A4 size (of the A Series Standard used in Japan) sheets of paper arranged vertically and applying label-like sheets of printing medium thereto horizontally, whereas the short mode may refer to the use of blank post cards arranged horizontally (or vertically) and applying label-like sheets of printing medium thereto horizontally.

Reference numeral 32 in FIG. 2 denotes a volume control for controlling the volume with which the input speech is sounded for replaying and reference numeral 34 denotes a cutter lever for operating the built-in cutter to cut and separate the printed label-like sheet of printing medium 14 from the unprinted sheets. Reference numeral 36 denotes a number of jacks to be used for externally inputting/outputting a speech.

The speech input start operation section 20, the replay operation section 22, the printing operation section 24 and the stop operation section 26 operate as part of operation mode selector 42 with an input/output operation control section 38 and an operation mode control section 40. The operation signals from the speech input start operation section 20, the replay operation section 22, the printing operation section 24 and the stop operation section 26 are entered to the operation mode control section 40 by way of the input/output operation control section 38. The operation mode control section 40 controls the operation of each of speech input processing section 44, speech output control section 46, code image converting section 48 and printer output control section 50 according to the present operation mode and the corresponding operation signal it receives as will be described in detail hereinafter.

The speech input control section 44 performs processing operations including amplification, filtering and A/D conversion on the speech signal input through the microphone 10. The speech input processing section 44 is made ready for starting its operation by an operation signal from the speech input start operation section 20 and for stopping its operation by an operation signal from the stop operation section 26, although it does not start its operation until authorized by the operation mode control section 40.

The digital speech data output from the speech input processing section 44 is compressed/encoded for every speech frame unit of 30 msec by a speech data compression/encoding section 52 and stored in a temporary data storage section 54. Speech data volume detecting section 56 has a receivable input data computing section 58 that computes the speech volume that can still be input into the recording apparatus on the basis of the number of frames compressed by the speech data compression/encoding section 52 and the number of frames corresponding to the total speech volume to be input set by the parameter setting section 30 and sends the outcome of the computation to a data volume display drive section 60 by way of the input/output operation control section 38. The data volume display drive section 60 energize the five LEDs of the volume of receivable input/progress of speech reproduction indicator 28A to display the speech volume that can still be received by the recording apparatus.

The speech output control section 46 performs processing operations including amplification, filtering and D/A conversion on the speech data to be reproduced from the loudspeaker 12. The speech output control section 46 is made ready for starting its operation by an operation signal from the replay operation section 22 and stopping its operation by an operation signal from the stop operation section 26, although it does not start its operation until authorized by the operation mode control section 40.

The speech data sent to the speech output control section 46 is a data obtained by expanding the compressed/encoded data stored in the temporary data storage section 54 by means of a speech data expansion processing section 62. At this time, a data indicating the number of frames subjected to the expansion processing operation of the speech data expansion processing section 62 is fed to replay data volume computing section 64 of the speech data volume detecting section 56 from the speech data expansion processing section 62. The replay data volume computing section 64 determines by computation the volume of data reproduced from data stored in the temporary data storage section 54. The outcome of the computing operation is then fed to the data volume display drive section 60 by way of the input/output operation control section 38 so that the progress of speech reproduction is indicated as the five LEDs of the volume of receivable input/progress of speech reproduction indicator 28A are energized.

The printer output control section 50 controls the printer 16 to print the code image of the dot codes converted by the code image converting section 48. The printer output control section 50 is made ready for starting its operation by an operation signal from the printing operation section 24 and stopping its operation by an operation signal from the stop operation section 26, although it does not start its operation until authorized by the operation mode control section 40.

The code image converting section 48 that feed the printer output control section 50 with a code image of dot codes comprises an encoding processing section 66 for encoding compressed/encoded speech data stored in the temporary data storage section 54 and a code image generation/output section 68 for converting coded data into a code image and outputting the generated code image. The operation of the encoding processing section 66 is controlled by the operation mode control section 40. Parameters including the compression ratio, the resolution, the number of block rows and the length of the parts obtained by dividing the dot codes necessary for encoding and outputting a code image are set by means of the parameter setting section 30.

The code image generation/output section 68 has a memory (not shown) for storing the generated code image so that a same dot code pattern 1 can be duplicatively reproduced simply by operating the printing operation section 24.

Now, the operation of the embodiment of code image recording apparatus having the above described configuration will be described below.

Referring to FIG. 4, this embodiment of code image recording apparatus starts encoding the input speed and generating a code image of the input speech by the code image converting section 48 immediately after the completion of the speech input operation using the microphone 10.

As the user has the replay operation section 22 start reproducing the input speech in order to ensure the speech input by him or her, the processing operation of reproducing the input speech is conducted concurrently on a time division basis with that of encoding the speech and that of generating code image data for the speech. It may be needless to say that the reproduced speech does not provide any unpleasant feeling to the user if it is reproduced on a time division basis.

Figure 5A:
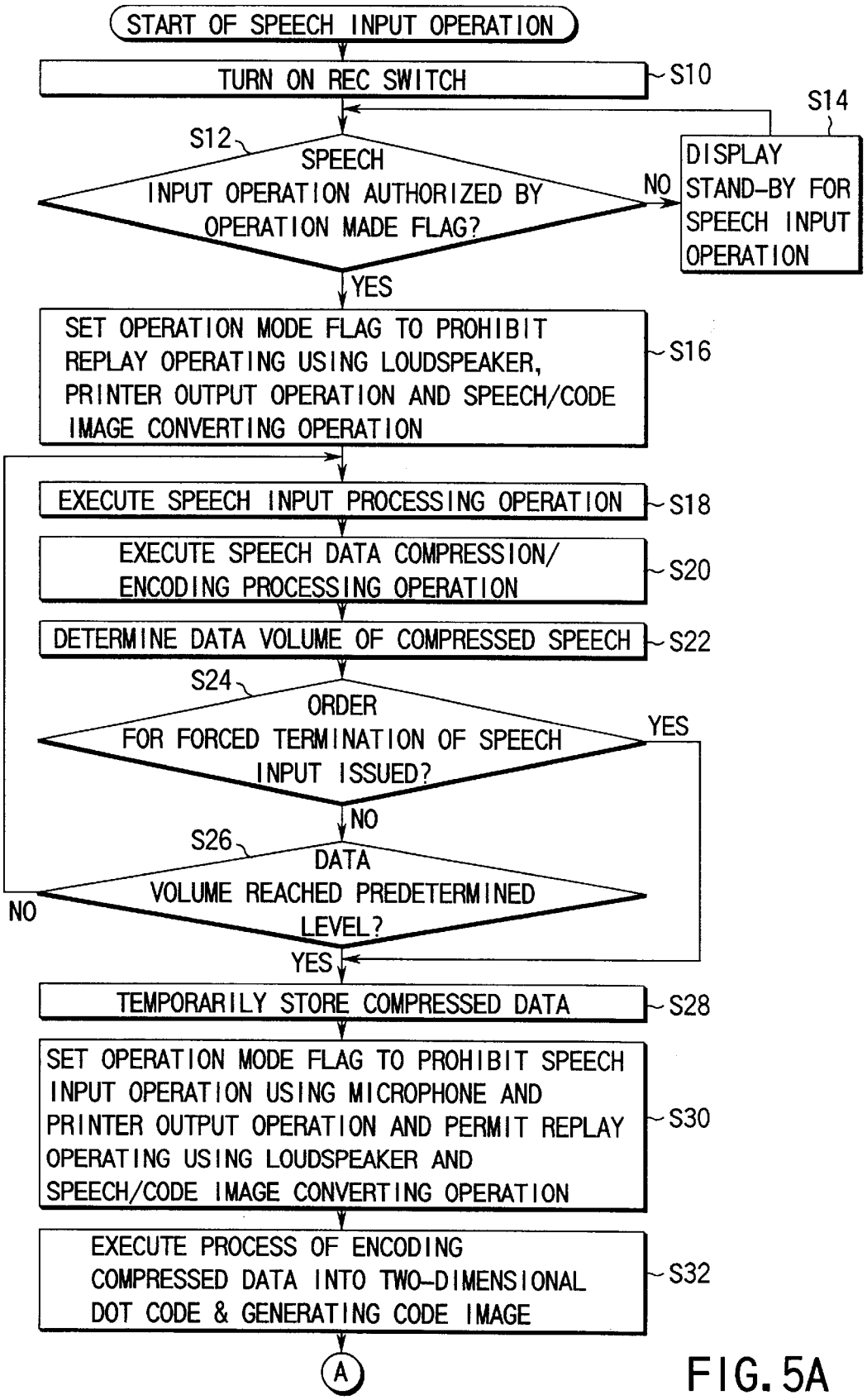
FIGS. 5A and 5B are a flow chart shown in two parts of the operation of entering a speech through a microphone, that of encoding the input speech and that of printing out a code image of the speech.
Figure 5B:
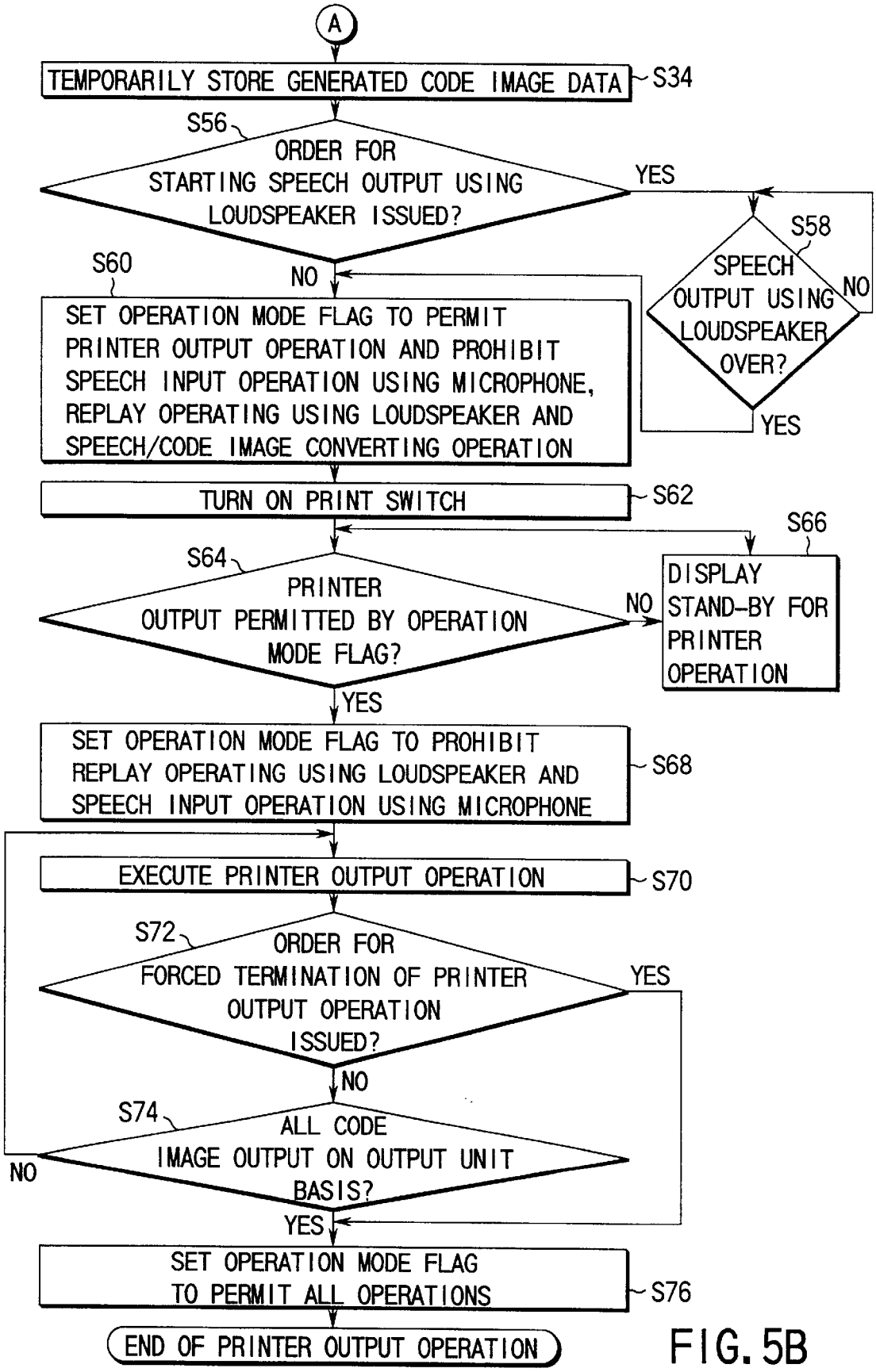

The concurrent processing operations will now be described by referring to the flow charts of FIGS. 5A, 5B and 6.

As the "REC" button 20A of the speech input start operation section 20 is depressed (Step S10), the operation mode control section 40 reads the current status of the operation mode flag and determines if a speech input operation using the microphone 10 is permitted or not (Step S12). As shown in FIG. 7, the operation mode flag is a 8-bit data, where bit "1" indicates if a speech input operation using the builtin microphone 10 is permitted or not and bit "2" indicates if a speech output operation using the loudspeaker 12 is permitted or not, whereas bit "3" indicates if an operation of outputting the dot code pattern that corresponds to the input speech to the printer 16 is permitted for printing or not and bit "4" indicates if the overall operation of the code image recording apparatus is authorized or not. Thus, "00000001" indicates a state where only a speech input operation using the microphone is authorized and "00000010" indicates a state where only a speech replay operation using the loudspeaker 12 is permitted, whereas "00000100" indicates that a printing operation using the printer 16 is permitted and "00001000" indicates a state where only an operation of transforming the input speech into a code image by the code image converting section 48 is authorized. The operation mode flag of "00001111" indicates that all of the microphone 10, the loudspeaker 12, the printer 16 and the code image converting section 48 can be operated. The operation mode flag of "00001010" indicates a state where both a speech replay operation using the loudspeaker 12 and an operation of transforming the input speech into a code image by the code image converting section 48 are authorized.

In an operation mode where no speech input operation using the microphone 10 is authorized, the stand-by state is typically displayed to the user in the form of an error message (not shown) (Step S14) and the processing operation returns to Step S12.

On the other hand, in an operation mode where only an operation of entering a speech by means of the microphone is authorized, an operation mode flag of "00000001" is set to prohibit an operation of reproducing the speech by means of the loudspeaker 12, that of using the printer 16 and that of the code image converting section 48 for transforming an input speech into a code image (Step S16).

The operation mode control section 40 authorizes the speech input processing section 44 to carry out an input processing operation on the speech signal input through the microphone 10 (Step S18). The speech data compression/encoding section 52 compresses and encodes the speech data from the speech input processing section 44 (Step S20) and the receivable input data computing section 58 determines the speech volume compressed by the speech data compression/encoding section 52 and causes the volume of receivable input/progress of speech reproduction indicator 28A of the data volume display section 28 to display the speech volume that can still be input into the recording apparatus by means of the data volume display drive section 60 (Step S22).

The operation mode control section 40 checks if an order for forced termination of speech input operation is given by the user by depressing the "STOP" button 26A of the stop operation section 26 during the speech input operation (Step S24) and, if such an order is given, it proceeds to Step S28, which will be discussed hereinafter. If an order for forced termination of speech input operation is not given, it determines if the volume of the data already input has got to the data volume preselected by the parameter setting section 30 or not on the basis of the outcome of the computation of the receivable input data computing section 58 (Step S26) and returns to Step S18 if the volume of the data already input has not got to the preselected volume.

If, on the other hand, it is found that the volume of the data already input has reached the preselected data volume and if it is found in Step S24 that an order for forced termination of speech input operation is given, the speech data that have been compressed/encoded by the speech data compression/encoding section 52 are stored in the temporary data storage section 54 (Step S28). Then, the operation mode control section 40 sets the operation mode flag of "00001010" to prohibit an operation of entering a speech by way of the microphone 10 and that of using the printer 16 but permit the loudspeaker 12 and the code image converting section 48 respectively to output a speech and to operate for converting a speech into a code image (Step S30). Immediately thereafter, it gives an operation command to the encoding processing section 66 to have the latter encode the compressed speech data stored in the temporary data storage section 54 and have the code image generation/output section 68 generate a code image of dot code pattern 1 (Step S32), which is then temporarily stored in the memory (not shown) arranged in the code image generation/output section 68 (Step S34).

Figure 6:
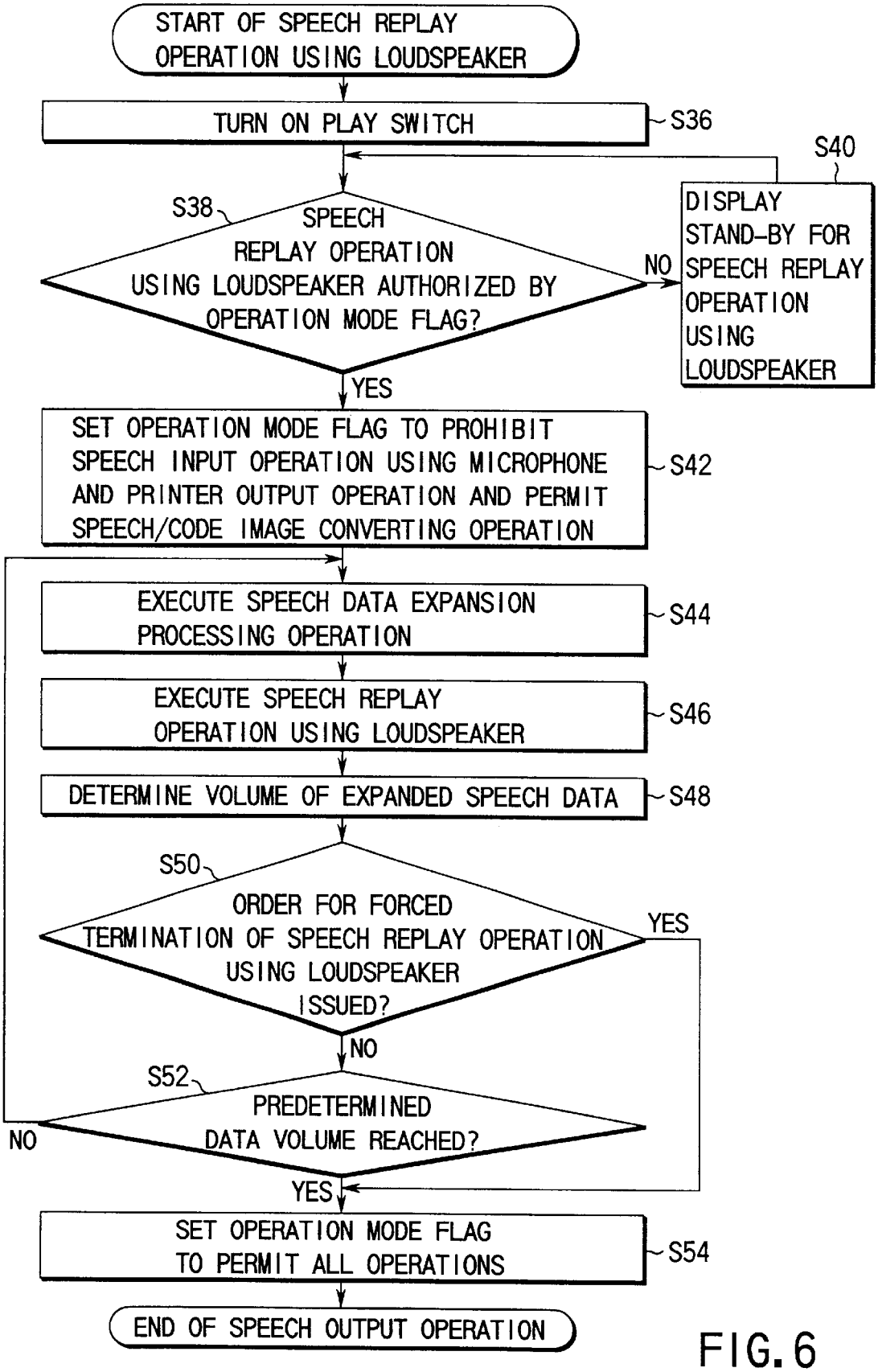
FIG. 6 is a flow chart of the operation of reproducing an input speech by means of a loudspeaker.

At this time, the operation mode control section 40 determines the current status of the "PLAY" button 22A of the replay operation section 22 as shown in FIG. 6. If the "PLAY" button 22A has been operated (Step S36), the operation mode flag recognizes it and determines if the loudspeaker 12 is currently authorized to reproduce a speech or not (Step S38). If the loudspeaker 12 is not currently authorized to reproduce a speech, it displays a stand-by state on the error display section (not shown) to notify the user of the fact that no speech replay operation using the loudspeaker 12 is currently authorized (Step S40) before it returns to Step S38.

If, on the other hand, the loudspeaker 12 is currently authorized to reproduce a speech, it selects an operation mode flag of "00001010" to prohibit the microphone 10 to be used for inputting a speech and also the printer 16 to operate but permit the code image converting section 48 to operate for encoding the input speech (Step S42). It will be appreciated that the operation mode flag is set to prohibit both the microphone 10 and the printer 16 to operate while the loudspeaker 12 is operating to reproduce the input speech.

The operation mode control section 40 authorizes the speech output control section 46 to operate and cause the speech data expansion processing section 62 to expand the compressed and encoded speech data stored in the temporary data storage section 54 (Step S44) and the loudspeaker 12 to output the obtained speech (Step S46). The replay volume computation section 64 determines by computation the volume of speech data expanded by the speech data expansion processing section 62 and causes the data volume display drive section 60 to make the volume of receivable input/progress of speech reproduction indicator 28A of the data volume display section 28 display the progress of the relay operation (Step S48).

The operation mode control section 40 checks if an order for forced termination of speech replay operation is given by the user by depressing the "STOP" button 26A of the stop operation section 26 during the speech replay operation (Step S50) and, if such an order is given, it proceeds to Step S54, which will be discussed hereinafter. If an order for forced termination of speech replay operation is not given, it determines if the volume of speech already output has got to the level corresponding to the input data volume preselected by the parameter setting section 30 or not on the basis of the outcome of the computation of the replay volume computation section 64 (Step S52) and returns to Step S44 if the volume of speech already output has not got to that level.

To the contrary, if it is determined that a speech corresponding to the set volume of data has been output or if a command for forced termination of speech replay operation using the loudspeaker 12 is issued in Step S50, the operation mode control section 40 sets an operation mode flag of "00001111" to allow all the related components to operate (Step S54) and terminates the speech reproducing operation using the loudspeaker 12.

Thus, since the speech reproducing operation using the loudspeaker 12 can be conducted concurrently with an encoding operation and a code image data generating operation of the code image converting section 48, the operation mode control section 40, upon receiving a command for starting a speech reproducing operation using the loudspeaker 12 (Step S56), waits for the completion of the speech reproducing operation using the loudspeaker 12 (Step S58) before its set an operation mode flag of "00000100" to prohibit the microphone 10, the loudspeaker 12 and the code image converting section 48 to operate but authorize only the printer 16 to operate (Step S60).

As the "PRINT" button 24A of the printing operation section 24 is depressed (Step S62), the operation mode control section 40 reads the current status of the operation mode flag to determine if a printer output operation is authorized or not (Step S64). If it is found that a printer output operation is no authorized, the stand-by state is typically displayed to the user in the form of an error message (not shown) (Step S66) and the processing operation returns to Step S64.

On the other hand, in an operation mode where a printer output operation is authorized, the operation mode flag is set to "00000100" to prohibit any speech output from the loudspeaker 12 and any speech input operation through the microphone 10 (Step S68). Thereafter, the operation mode control section 40 authorizes the printer output control section 50 to carry out a printer output processing operation of printing a code image of dot codes sent from the code image converting section 48 on a label-like printing medium 14 by means of the printer 26 (Step S70).

The operation mode control section 40 checks if an order for forced termination of printer output operation is given by the user by depressing the "STOP" button 26A of the stop operation section 26 during the printer output processing operation (Step S72) and, if such an order is given, it proceeds to Step S76, which will be discussed hereinafter. If an order for forced termination of printer output operation is not given, it determines if all the code image expressed in terms of output unit and generated by the code image generation/output section 68 has been output or not (Step S74) and returns to Step S70 if all the code image has not been output.

If, on the other hand, it is determined that all the data on the code pattern image have been output on an output unit basis or a command for forced termination of printing operation is issued in Step S72, the operation mode control section 40 sets an operation mode flag of "00010000" to allow all the related components to operate (Step S76) and terminates the output operation using the printer 16.

Now, a second embodiment of the invention will be described, while this embodiment has a configuration similar to that of the above described first embodiment, a speech reproducing operation using the loudspeaker 12 is conducted after the input of the speech through the microphone 10 not upon receiving an order for the speech reproduction from the user but immediately after the speech input without waiting for such an order.

Figure 8A:
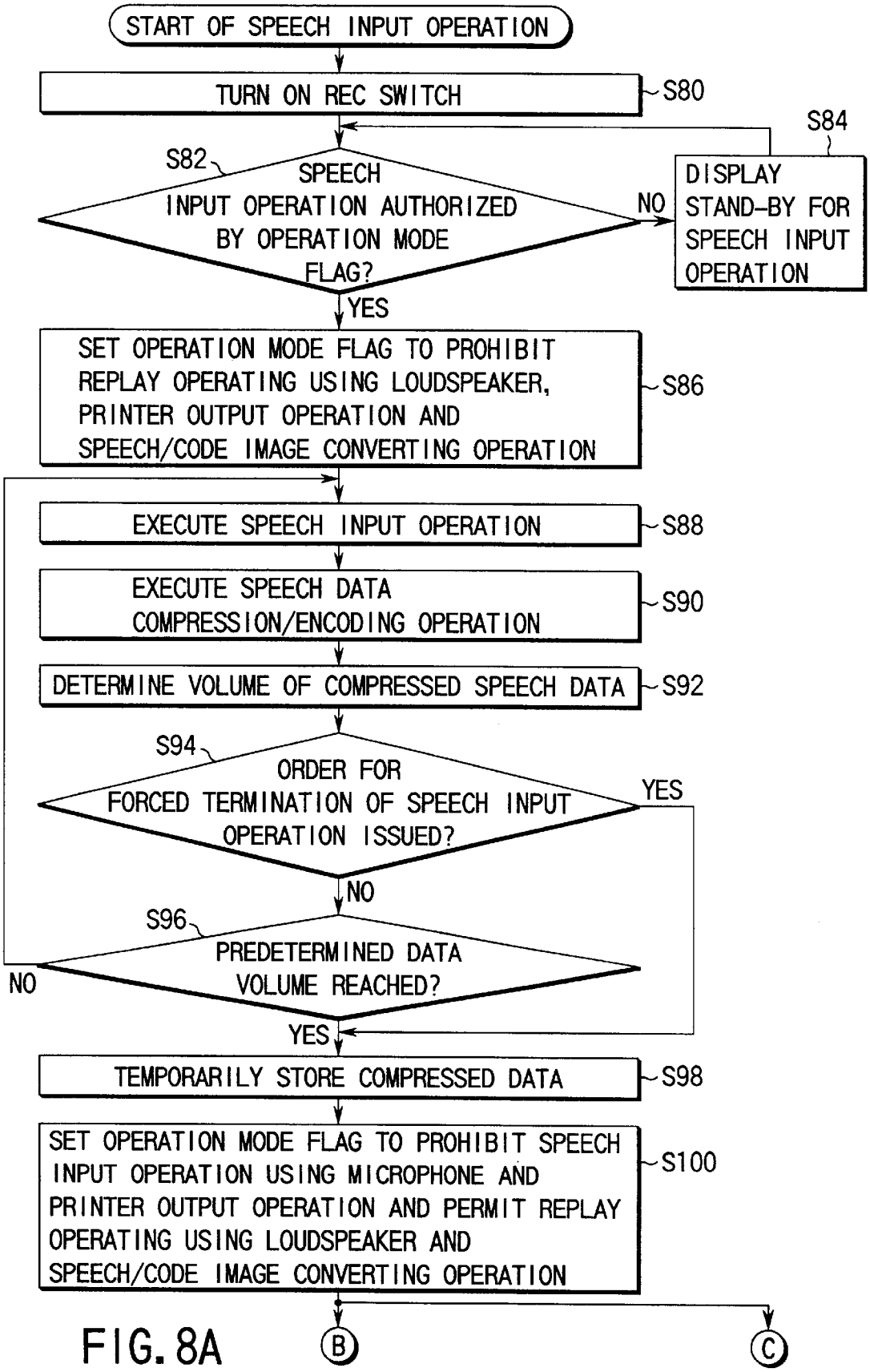
FIGS. 8A through 8C are a flow chart in three parts of the operation of a second embodiment of the invention.
Figure 8B:
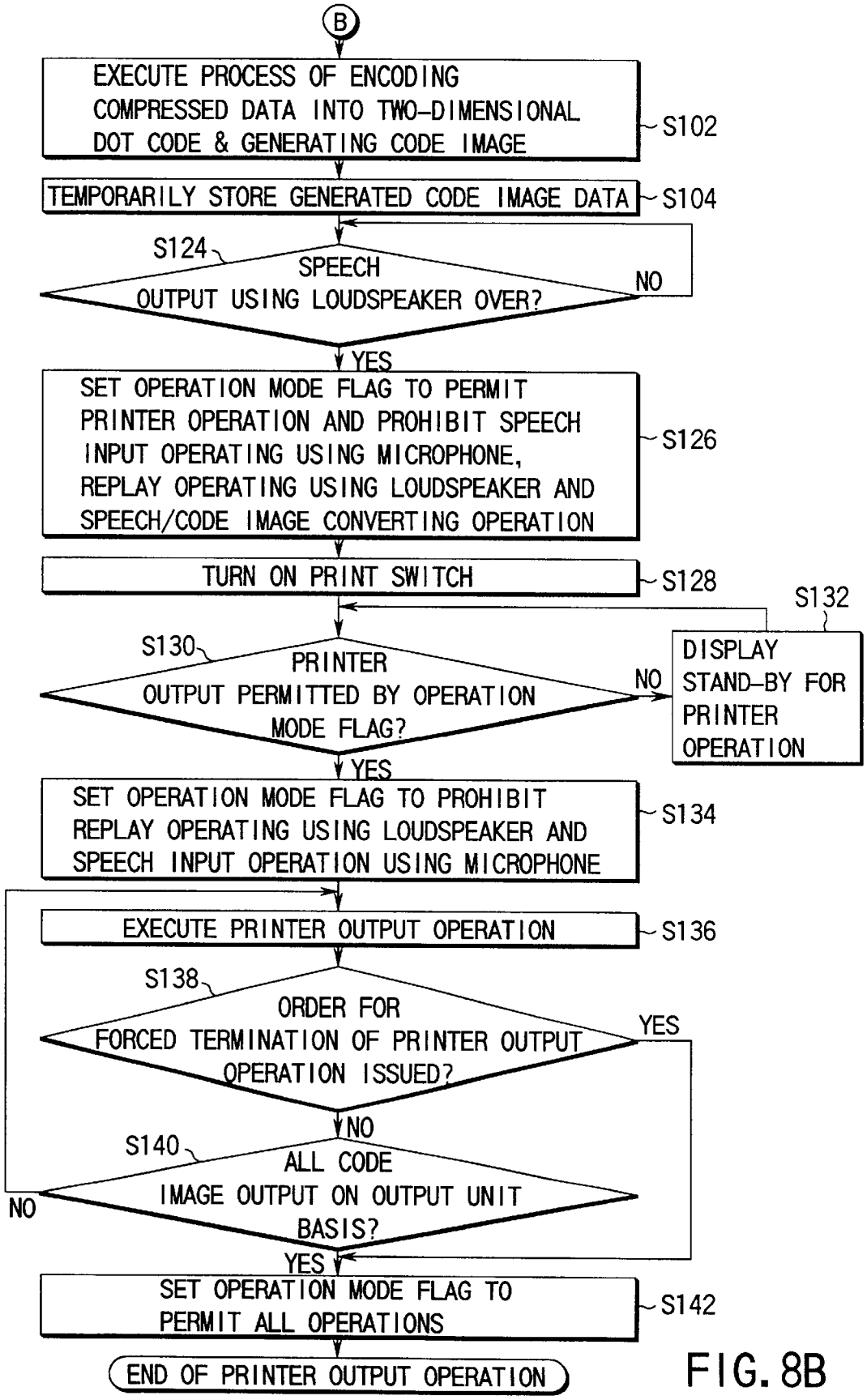
Figure 8C:
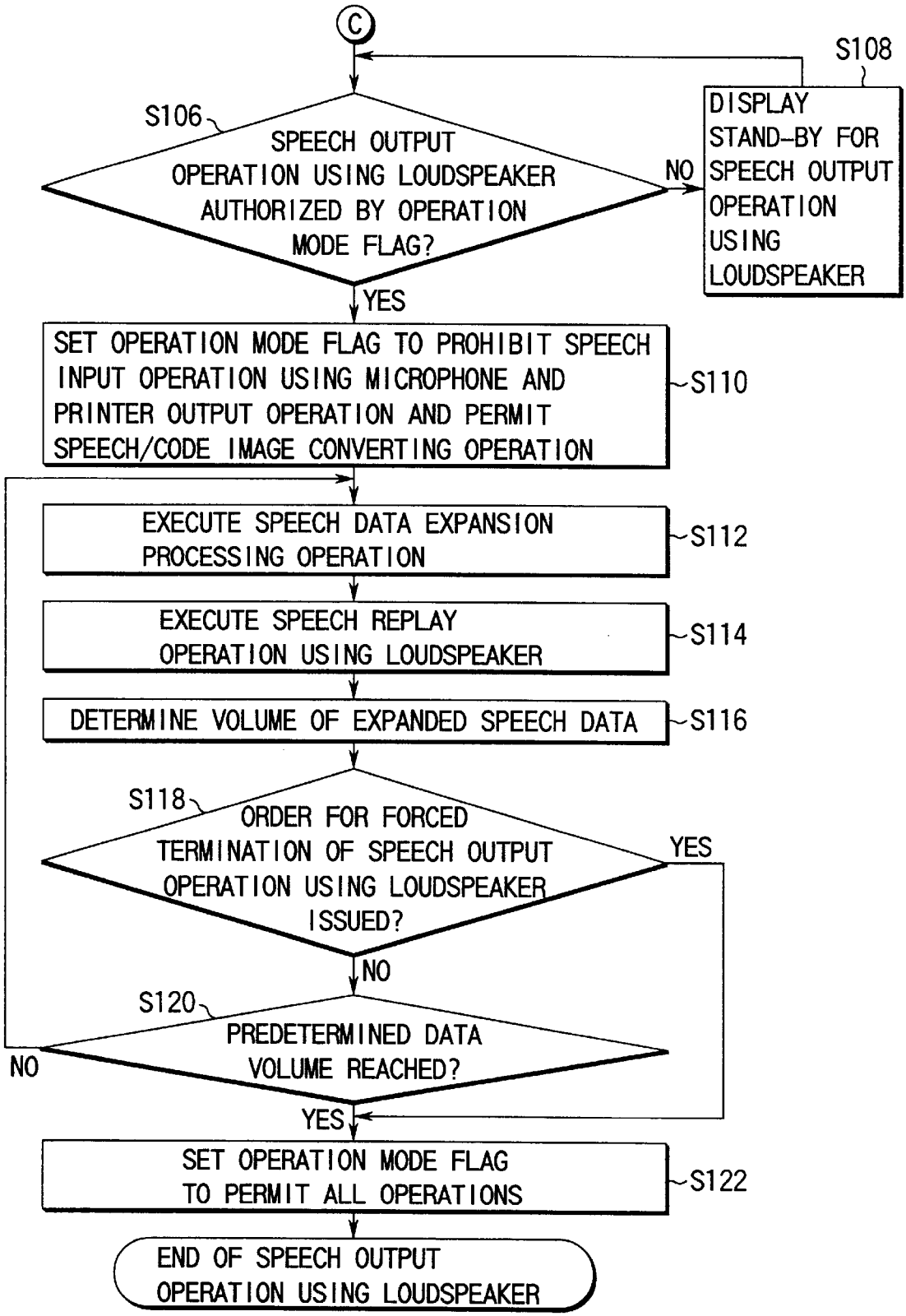

FIGS. 8A through 8C show a flow chart in three sections for the above operation of the second embodiment. Since Steps S80 through S100 are identical with Steps S10 through S30 of the first embodiment, they will not be described here any further.

In Step S100, the operation mode control section 40 sets an operation mode flag of "00001010" to prohibit the microphone 10 to be used for inputting a speech and also the printer 16 to operate but permit the loudspeaker 12 and the code image converting section 48 respectively to output a speech and to operate for converting a speech into a code image, an encoding operation and a speech reproducing operation using the loudspeaker 12 are started immediately and concurrently without waiting for any order from the user.

More specifically, the operation mode control section 40 authorizes the encoding processing section 66 to operate for encoding the compressed speech data stored in the temporary data storage section 54 and have the code image generation/output section 68 generate a code image of dot code pattern 1 (Step S102), which is temporarily stored in the memory (not shown) arranged in the code image generation/output section 68 (Step S104). At the same time, the operation mode control section 40 determines if any speech reproducing operation using the loudspeaker 12 is currently authorized or not (Step S106) and, if a speech reproducing operation using the loudspeaker 12 is not currently authorized, it displays a stand-by state on the error display section (not shown) to notify the user of the fact that no speech replay operation using the loudspeaker 12 is currently authorized (Step S108) before it returns to Step S106.

If, on the other hand, it is determined that the loudspeaker 12 is currently authorized to reproduce a speech, it sets an operation mode flag of "00001010" to prohibit the microphone 10 to be used for inputting a speech and also the printer 16 to operate but permit the code image converting section 48 to operate for transforming the input speech into a code image (Step S110) and authorizes the speech output control section 46 to operate and cause the speech data expansion processing section 62 to expand the compressed and encoded speech data stored in the temporary data storage section 54 (Step S112) and the loudspeaker 12 to output the obtained speech (Step S114). The replay volume computation section 64 determines by computation the volume of speech data expanded by the speech data expansion processing section 62 and causes the data volume display drive section 60 to make the volume of receivable input/progress of speech reproduction indicator 28A of the data volume display section 28 display the progress of the relay operation (Step S116).

The operation mode control section 40 checks if an order for forced termination of speech replay operation is given by the user by depressing the "STOP" button 26A of the stop operation section 26 during the speech replay operation (Step S118) and, if such an order is given, it proceeds to Step S122, which will be discussed hereinafter. If an order for forced termination of speech replay operation is not given, it determines if the volume of speech already output has got to the level corresponding to the input data volume preset by the parameter setting section 30 or not on the basis of the outcome of the computation of the replay volume computation section 64 (Step S120) and returns to Step S112 if the volume of speech already output has not got to that level.

If, on the other hand, it is found that the volume of speech already output has reached the level corresponding to the input data volume or an order for forced termination of speech replay operation is given in Step S118, the operation mode control section 40 sets an operation mode flag of "00001111" to indicate that all intended operations of the code image recording apparatus are authorized (Step S122) before terminating the replay operation using the loudspeaker 12.

Thus, as described above in detail, a speech replay operation of the loudspeaker 12 can be conducted concurrently with an encoding operation and a code image data generating operation of the code image converting section 48, the operation mode control section 40 just waits for the completion of the speech replay operation using the loudspeaker 12 (Step S124) before it sets an operation mode flag of "00000100" for prohibiting the microphone 10, the loudspeaker 12 and the code image converting section 48 to operate but allowing the printer 16 to operate (Step S126).

Thereafter, if the "PRINT" button 24A of the printing operation section 24 is depressed (Step S128), the operation mode control section 40 reads the currently effective operation mode flag and determines if the printer is authorized for output operation (Step S130). If it is determined that the printer 16 is not authorized for output operation, it displays a stand-by state on the error display section (not shown) to notify the user of the fact that no printing operation using the printer 16 is currently authorized (Step S132) before it returns to Step S130.

If, on the other hand, it is determined that the printer 16 is authorized for output operation, it sets a operation mode flag of "00000100" to prohibit any speech output operation of the loudspeaker 12 and any speech input operation of the microphone 10 (Step S134) but authorize the printer output control section 50 to operate and have the printer 16 print the code image of dot code pattern output from the code image converting section 48 on a label-like recording medium 14 (Step S136).

During the output operation of the printer 16, the operation mode control section 40 checks if an order for forced termination of output operation of the printer 16 is given by the user by depressing the "STOP" button 26A of the stop operation section 26 (Step S138) and, if such an order is given, it proceeds to Step S142, which will be discussed hereinafter. If an order for forced termination of output operation of the printer 16 is not given, it determines if all the code image generated by the code image generation/output section 68 of the code image converting section 48 has been output on an output unit basis (Step S140) and returns to step S136 if it has not been output.

If, on the other hand, it is found that all the code image has been output on an output unit basis or an order for forced termination of output operation of the printer 16 is given in Step S138, the operation mode control section 40 sets an operation mode flag of "00001111" to indicate that all intended operations of the code image recording apparatus are authorized (Step S142) before terminating the output operation using the printer 16.

Thus, a code image recording apparatus according to the invention is adapted for the user to ensure the speech input by him or her by reproducing it through a speech output means, utilizing the stand-by time necessary for the apparatus to complete the process of transforming the input speech into a code image, by controlling concurrently the encoding operation of the apparatus and the speech reproducing operation using the loudspeaker 12.

While the speech data expansion processing section 62, the encoding processing section 66 and the code image generation/output section 68 are operated by a single CPU in the above described first and second embodiments so that the data expansion operation and the encoding processing and image generation operations must be executed on a time series basis as shown in FIG. 4, the above three operations may be concurrently executed if there is provided additional hardware exclusive to the above respective three sections 62, 66 and 68.

While the present invention is described above by referring to preferred embodiments, the present invention is not limited thereto and the above embodiments can be altered or modified in many different ways without departing from the scope of the invention.

The present invention may be summarized as follows.

(1) A code image recording apparatus comprising:

speech input means for inputting speech;

code image converting means for converting the speech input by the speech input means into a code image of encoded data arranged according to a predetermined format;

a printer for printing the code image converted by the code image converting means on a predetermined printing medium as an optically readable image;

speech output means for outputting the speech input by the speech input means;

operation mode setting means for setting a speech output mode adapted to cause the speech output means to output the speech input by the speech input means and a code image conversion mode adapted to cause the code image converting means convert the speech input by the speech input means to; and mode selection control means for allowing, when one of the above operation modes is set by the mode setting means, the operation mode setting means to further set another operation mode.

With the above arrangement, when a speech output mode (indicating a state where the user can confirm the speech input by him or her by replaying it) is set, a code image conversion mode (indicating a state where an operation of transforming a speech into a code image is authorized) can be set concurrently and vice versa so that the user may be able to start a code image printing operation immediately or shortly after confirming the speech by reproducing it, thereby effectively exploiting the time between the speech input and the final stage of printing a code image for the speech, and preventing the user from being bored as he or she is held in a stand-by state.

(2) A code image recording apparatus comprising:

speech input means for inputting speech;

code image converting means for converting the speech input by the speech input means into a code image of encoded data arranged according to a predetermined format;

a printer for printing the code image converted by the code image converting means on a predetermined printing medium as an optically readable image;

speech output means for outputting the speech input by the speech input means;

operation mode setting means for setting a speech output mode adapted to cause the speech output means to output the speech input by the speech input means and a code image conversion mode adapted to cause the code image converting means to convert the speech input by the speech input means; and mode selection control means for enabling the operation mode setting means to set the code image conversion mode after the speech output mode has been set.

With the above arrangement, when the user sets a state where he or she can replay and confirm the speech input (speech output mode), he or she can also set a state where the input speech is converted into a code image (code image conversion mode) so that the user may be able to start a code image printing operation immediately or shortly after confirming the speech by reproducing it, thereby effectively exploiting the time between the speech input and the final stage of printing a code image for the speech, and preventing the user from being bored as he or she is held in a stand-by state.

(3) A code image recording apparatus comprising:

speech input means for inputting speech;

code image converting means for converting the speech input by the speech input means into a code image of encoded data arranged according to a predetermined format;

a printer for printing the code image converted by the code image converting means on a predetermined printing medium as an optically readable image;

speech output means for outputting the speech input by the speech input means;

operation mode setting means for setting a speech output mode adapted to cause the speech output means to output the speech input by the speech input means and a code image conversion mode adapted to cause the code image converting means to convert the speech input by the speech input means; and mode selection control means for enabling the operation mode setting means to set the speech output mode after the code image conversion mode has been set.

With the above arrangement, when the user sets a state where the input speech is converted into a code image (code image conversion mode), he or she can also set a state where he or she can replay and confirm the speech input (speech output mode) so that the user may be able to start a code image printing operation immediately or shortly after confirming the speech by reproducing it, therby effectively exploiting the time between the speech input and the final stage of printing a code image for the speech, and preventing the user from being bored as he or she is held in a stand-by state.

(4) A code image recording apparatus comprising:

speech input means for inputting speech;

code image converting means for converting the speech input by the speech input means into a code image of encoded data arranged according to a predetermined format;

a printer for printing the code image converted by the code image converting means on a predetermined printing medium as an optically readable image;

speech output means for outputting the speech input by the speech input means;

operation mode setting means for setting a speech output mode adapted to cause the speech output means to output the speech input by the speech input means and a code image conversion mode adapted to cause the code image converting means to convert the speech input by the speech input means; and mode selection control means for controlling the operation mode setting means to compulsorily set the speech output mode after the code image conversion mode has been set.

With the above arrangement, once a state where the input speech is converted into a code image (code image conversion mode) is set, a state of confirming the speech input (speech output mode) will be followed so that the user may be able to start a code image printing operation immediately or shortly after confirming the speech by reproducing it, therby effectively exploiting the time between the speech input and the final stage of printing a code image for the speech, and preventing the user from being bored as he or she is held in a stand-by state.

Additional advantages and modifications will readily occur to those skilled in the art. Therefore, the invention in its broader aspects is not limited to the specific details, and representative devices shown and described herein. Accordingly, various modifications may be made without departing from the spirit or scope of the general inventive concept as defined by the appended claims and their equivalents.

What is claimed is:

1. A code image recording apparatus comprising:

speech input means for inputting speech;

code image converting means for converting the speech input by said speech input means into a code image of encoded data arranged according to a predetermined format;

a printer for printing the code image converted by said code image converting means on a predetermined printing medium as an optically readable image;

speech output means for outputting the speech input by said speech input means;

operation mode setting means for setting a speech output mode adapted to cause said speech output means to output the speech input by said speech input means and a code image conversion mode adapted to cause said code image converting means to convert the speech input by said speech input means; and mode selection control means for allowing, when one of the speech output and code image conversion modes is set by said mode setting means, said operation mode setting means to further set another operation mode.

2. A code image recording apparatus comprising:

speech input means for inputting speech;

code image converting means for converting the speech input by said speech input means into a code image of encoded data arranged according to a predetermined format;

a printer for printing the code image converted by said code image converting means on a predetermined printing medium as an optically readable image;

speech outputting means for outputting the speech input by said speech input means;

operation mode setting means for setting a speech output mode adapted to cause said speech output means to output the speech input by said speech input means and a code image conversion mode adapted to cause said code image converting means to convert the speech input by said speech input means into the code image; and mode selection control means for enabling said operation mode setting means to set the code image conversion mode after the speech output mode has been set.

3. A code image recording apparatus comprising:

speech input means for inputting speech;

code image converting means for converting the speech input by said speech input means into a code image of encoded data arranged according to a predetermined format;

a printer for printing the code image converted by said code image converting means on a predetermined printing medium as an optically readable image;

speech output means for outputting the speech input by said speech input means;

operation mode setting means for setting a speech output mode adapted to cause said speech output means to output the speech input by said speech input means and a code image conversion mode adapted to cause said code image converting means to convert the speech input by said speech input means; and mode selection control means into the code image for enabling said operation mode setting means to set the speech output mode after the code image conversion mode has been set.

4. A code image recording apparatus comprising:

speech input means for inputting speech;

code image converting means for converting the speech input by said speech input means into a code image of encoded data arranged according to a predetermined format;

a printer for printing the code image converted by said code image converting means on a predetermined printing medium as an optically readable image;

speech output means for outputting the speech input by said speech input means;

operation mode setting means for setting a speech output mode adapted to cause said speech output means to output the speech input by said speech input means and a code image conversion mode adapted to cause said code image converting means to convert the speech input by said speech input means into the code image; and mode selection control means for controlling said operation mode setting means to compulsorily set the speech output mode after the code image conversion mode has been set.

* * * * *